United States Patent [19]

Wright

[11] Patent Number: 4,470,350

[45] Date of Patent: Sep. 11, 1984

[54] METHOD OF IMPACT PRINTING WITH ELECTROSTATIC OR MAGNETIC POWDER

[75] Inventor: Robert J. Wright, Adelaide, Australia

[73] Assignee: Research Laboratories of Australia PTY Limited, Eastwood, Australia

[21] Appl. No.: 444,586

[22] PCT Filed: Mar. 16, 1982

[86] PCT No.: PCT/AU82/00027

§ 371 Date: Nov. 15, 1982

§ 102(e) Date: Nov. 15, 1982

[87] PCT Pub. No.: WO82/03203

PCT Pub. Date: Sep. 30, 1982

[30] Foreign Application Priority Data

Mar. 17, 1981 [AU] Australia ..... PE8030

[51] Int. Cl.[3] ..... B41J 3/18

[52] U.S. Cl. ..... 101/426; 101/1; 101/DIG. 13; 400/119; 400/191; 427/197; 346/153.1

[58] Field of Search ..... 400/118, 119, 191; 101/1, DIG. 13, 426; 346/153.1, 156; 427/197, 198

[56] References Cited

U.S. PATENT DOCUMENTS

| | | | |
|---|---|---|---|
| 2,223,907 | 12/1940 | Bronfman | 101/226 |
| 2,495,389 | 1/1950 | Sammann | 101/288 |
| 2,558,900 | 7/1951 | Hooper | 101/DIG. 13 |
| 3,526,708 | 9/1970 | Leatherman | 101/426 |
| 3,682,738 | 8/1972 | Smith | 427/197 |
| 3,683,406 | 8/1972 | Howell | 346/153.1 |

*Primary Examiner*—Edgar S. Burr
*Assistant Examiner*—David A. Wiecking
*Attorney, Agent, or Firm*—Kinzer, Plyer, Dorn & McEachran

[57] ABSTRACT

A method of impact printing onto a receiving sheet on a platen by supplying powder to the sheet for pressure fixture by type face impact. The powder is temporarily held to the sheet by either electrostatic or magnetic force. In an alternate embodiment, the powder is held on the type face by electrostatic or magnetic force.

7 Claims, 3 Drawing Figures

METHOD OF IMPACT PRINTING WITH ELECTROSTATIC OR MAGNETIC POWDER

BACKGROUND OF THE INVENTION

Figure 1:
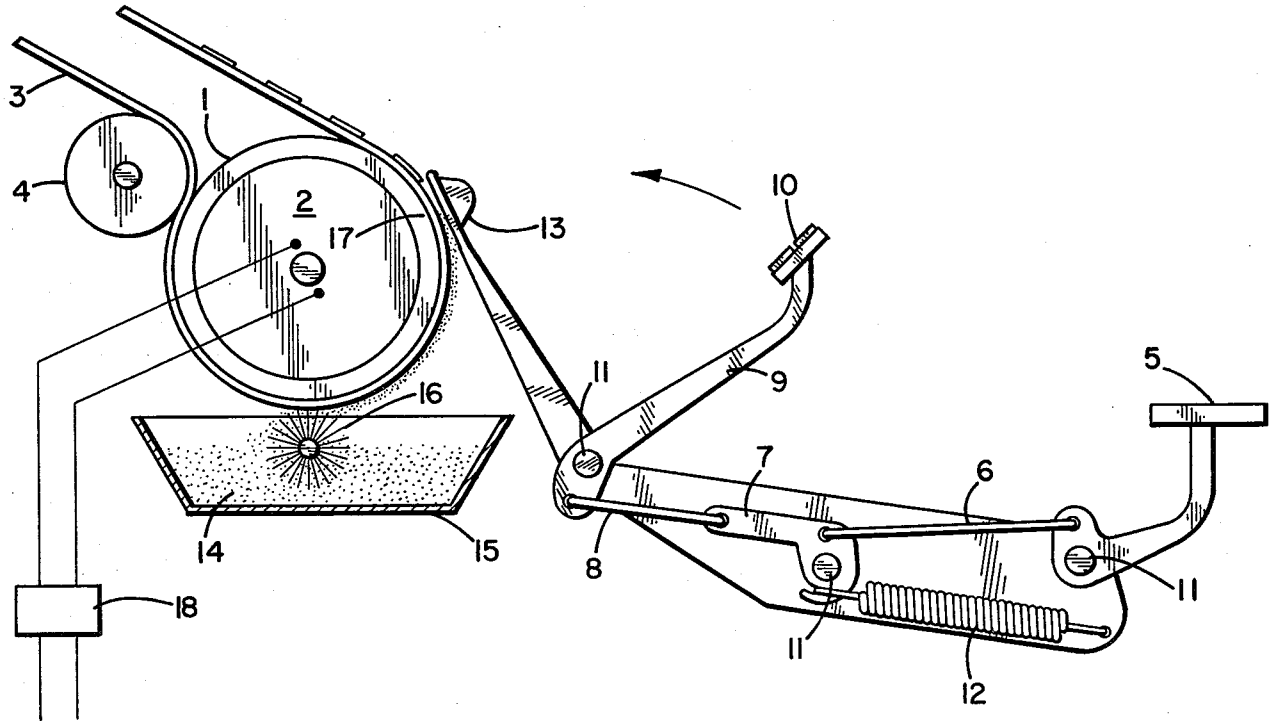

Impact printers are known, including the typewriter and various devices used for the printout of computer output data. Such devices normally involve positioning the back surface of a recording member such as a paper web against a backing member and positioning an ink bearing ribbon or the like against the front surface of such recording member. A movable member is then impacted against the rear surface of the ribbon. This movable member may comprise a relief alpha numeric character or the like, or may be a planar surface, in which instance relief alpha numeric characters are contained on the contacting surface of the backing member. In either instance pressure is applied in a pattern form corresponding to the relief pattern, causing pressure transfer of ink from the ribbon to the recording member surface.

A disadvantage of prior art impact printing processes is the transfer member or ink bearing ribbon, which is commonly used in repetitive manner. This results in a progressive loss of print density and in the production of copy of irregular density when the ribbon is partially and irregularly worn. In the past it has been proposed to wet the type face with a liquid ink prior to printing of each character, but while such procedure may be usable for printing of computer output, such methods are not readily adaptable to typewriting, particularly when the typewriter is in irregular use.

The present invention overcomes the disadvantages of the prior art impact printing processes in that it does not use an ink bearing ribbon, nor does it use a liquid ink.

DESCRIPTION OF THE INVENTION

The present invention relates to impact printers in general, and particularly to the commonly used typewriter. However, although this disclosure relates predominantly to typewriting, it should be understood that the disclosure is equally applicable to many of the presently known impact printers used for computer output. The disclosure should therefore be read as embracing computer output impact printing in addition to typewriting.

In a typewriter the paper sheet is normally positioned against a roller, known as a platen roller. Such platen roller is normally covered with an elastomeric sleeve to allow equalisation of printing pressure to some extent, and to reduce wear on the type face.

In one embodiment of the present invention the platen roller contains a magnetic or magnetisable core. Dry magnetic toner powder of the pressure fixing type, such as that for instance disclosed in U.S. Pat. No. 3,925,219 of STRONG and our U.S. Pat. application Ser. No. 128,906, now U.S. Pat. No. 4,307,169, is contained in a suitable container below the platen roller. Preferably sensors are provided to activate the magnetic field on the platen roller when a sheet of paper is inserted in the typewriter and to switch off said magnetic field when the sheet of paper is removed from the typewriter.

When the magnetic field is applied to the platen roller the dry magnetic toner powder is attracted towards the platen roller to form a loosely held layer of such powder on the paper sheet. When such powder layer is impacted with the type face the loosely held powder on the paper is pressure fixed thereto in imagewise configuration. As the paper sheet moves through the typewriter the unfused powder contained thereon is retained by the magnetic field in the vicinity of the platen roller. Thus the emerging sheet of paper contains a printed image deposit comprising pressure fixed magnetic toner on an otherwise clean and powder free paper sheet.

In other embodiments the relief type face characters on the type ball or roller or hammers or the like comprise magnetisable material, the pressure fixable magnetic dry toner powder being deposited thereon prior to the character to be printed being contacted with the paper.

In those instances in which it is for some reason not desirable to use magnetic dry toner powder, the type face or platen roller surface may comprise electrostatically chargeable material, or at least the outer surface thereof may comprise a dielectric layer. Pressure fixing dry toner particles of a non-magnetic type may then be used in conjunction with the electrostatically charged surface in a manner analogous to the magnetic applicator previously described.

It will be realised that at the instant of impact printing the pressure fixable toner particles will be in contact with each of the paper and the impacting means. To avoid fixing powder particles to the impacting means, such means should be coated with a release coating, such as a thin layer of a silicone oil or the like. Alternatively a directional electrostatic field may be applied at the instant of impact to urge the powder particles towards the paper and away from the impacting means.

In order however that the invention will be more fully understood, embodiments thereof will now be described with reference to the accompanying drawings in which—

Figure 2:
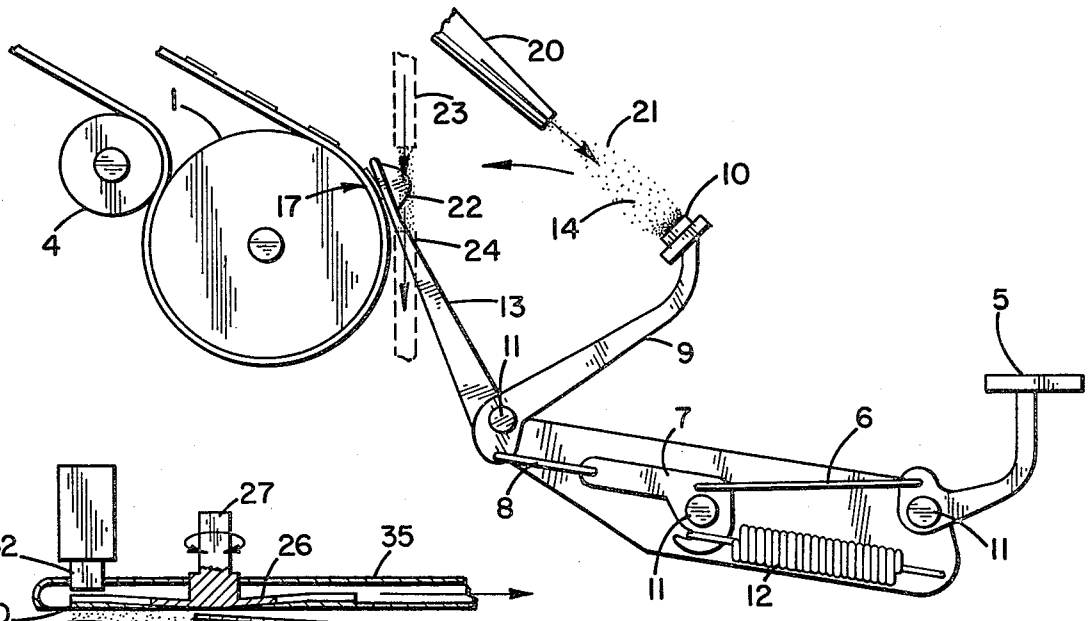
Figure 3:
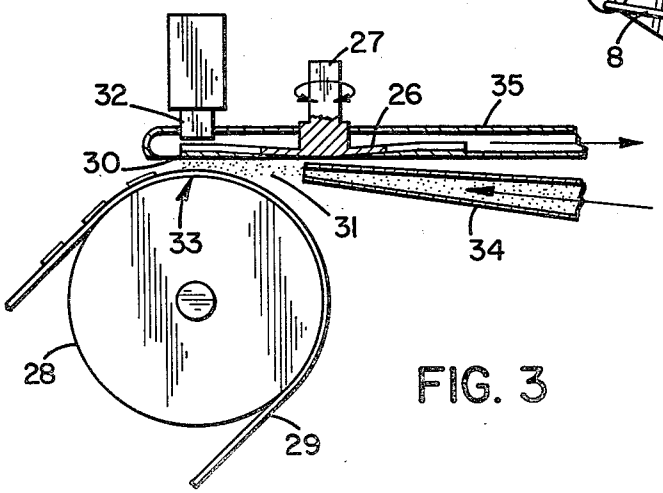

FIG. 1 is a schematic view of part of a typewriter mechanism according to the first referred to embodiment using an electromagnetic core and magnetically attractable powder, FIG. 2 is a similar view showing the system when the type faces are charged with a pressure fixable material, and FIG. 3 is a further schematic view showing a daisy wheel printer as generally used in electronic equipment.

In FIG. 1 the platen 1 has a magnetisable core 2 and has the receiving sheet 3 pass around it and loaded to move with the platen 1 by a pressure roller 4.

The normal keys 5 are connected by links 6, 7 and 8 to the striker arm 9 which carries the type face impact means 10. The pivots for the key 5, the link 7 and the striker arm 9 are designated 11. A return spring 12 is shown. The register guide is designated 13.

The pressure fixable powder 14 is carried in a container 15 and can conveniently be transferred to the surface of the receiving sheet 3 by an appropriately driven brush 16.

The magnetic core 2 holds the magnetisable powder 14 to the receiving sheet 3, and when the temporarily coated receiving sheet reaches the impacting area 17, the powder is pressure fixed by the type face impact means 10, but not at other areas. The loose powder carried on the receiving sheet 3 does not extend from the platen 1, being held by the field. When using a magnetisable core, as in the case illustrated in FIG. 1, the powder held by it can be released by de-energising the core 2, allowing the powder to fall back into the container 15. The core energising switch is designated 18.

Instead of using the feed of pressure fixable material to the receiving member 3 as shown in FIG. 1, the surface of the type face impact means 10 may be made to attract as shown in FIG. 2 to hold the pressure fixable powder 14, and the pressure fixable powder may be pressure ejected on to the face of the type face impact means 10.

As the device shown in FIG. 2 is similar to FIG. 1, corresponding parts have corresponding reference numerals. The variation in this form is that the pressure fixable powder is ejected from a nozzle 20. The supply of pressure fixable powder may in this embodiment by synchronised to occur when the key 5 commences to move the linkage so that a selected amount of the pressure fixable powder 14 is supplied to give an image of selected density. Because the pressure fixable powder is attracted to the type face the impact means 10, minimum loss of material will occur.

The pressure fixable powder 14 flow is indicated by the envelope 21 and it will be noted that it is drawn to the type face impact means 10 to ensure maximum capture and holding.

FIG. 2 also shows in dotted lines an alternative wherein a curtain 22 is formed across the path of the type face impact means 10, the curtain being formed by flowing the pressure fixable powder from a supply line 23 into a suction line 24.

The lines 23 and 24 can be part of a powder air conveying loop.

In FIG. 3 is shown how a daisy wheel 26 actuated from a shaft 27 is disposed adjacent a platen 28 around which the receiving member 29 passes, the type face impact segments 30 of the daisy wheel 26 being magnetic or magnetisable or having a surface to electrically attract and hold the pressure fixable material 31 and has striker means 32 whereby the selected type face impact means 30 are pressed down on to the receiving member 29.

The pressure fixable powder 31 is blown by an air flow to the impacting area 33 from the duct 34 and surplus powder is removed by a suction duct 35, the pressure fixable powder 31 being circulated from a container by air flow means of which the ducts 34 and 35 are part. These are not described herein as such circulating systems are known.

The daisy wheel 26 moves along the platen 28 for linear printing, and the platen turns to give line spacing in the usual manner.

To ensure substantially complete transfer of the pressure fixable powder an electrical transfer field is applied between the platen 28 and the type face impact segment 30 from a power supply 36 so that when a selected segment 30 is urged down by the impact means 32 on to the receiving sheet 29, the field will transfer to the said receiving sheet 29 that pressure fixable powder which is prior to that time electrically or electrostatically held to the character face of the segment.

This biassing can however, as referred to earlier herein, be replaced by treating the face of the type character segments 30 with a release agent such as silicone.

The claims defining the invention are as follows:

1. A method of impact printing which comprises passing a receiving sheet over a platen roller to contact said platen roller at an area facing type face impact means, supplying pressure fixable powder adapted to be deposited on at least an impact area on the said receiving sheet, and fixing the pressure fixable powder selectively to the said receiving sheet by moving said type face impact means to press the powder imagewise on to said receiving sheet; further characterised by said pressure fixable powder comprising magnetisable material and said platen roller containing an electromagnet whereby said pressure fixable powder is attracted towards such portion of said platen roller covered by said receiving sheet to cause said pressure fixable powder to be loosely applied to the surface of said receiving sheet in said impact area.

2. A method of impact printing which comprises passing a receiving sheet over a platen roller to contact said platen roller at an area facing type face impact means, supplying pressure fixable powder adapted to be deposited on at least an impact area on the said receiving sheet, and fixing the pressure fixable powder selectively to the said receiving sheet by moving said type face impact means to press the powder imagewise on to said receiving sheet; further characterised by said pressure fixable powder being applied to said type face impact means by electrostatic attraction thereto.

3. A method of impact printing as disclosed in claim 1 further characterised by said pressure fixable powder comprising said magnetisable material being retained in said impact area as said receiving member is advanced in contact with said platen roller excepting in those areas of said receiving member to which said pressure fixable material has been fixed by said type face impact means.

4. A method of impact printing which comprises passing a receiving sheet over a platen, applying pressure fixable powder to the said receiving sheet and holding the said pressure fixable powder on the said receiving sheet by energising a core in said platen to magnetically or electrostatically attract the said pressure fixable powder towards the said platen, fixing the said pressure fixable powder selectively to the said sheet by type face impact means, and holding unattached pressure fixable powder in the vicinity of the said platen by magnetic or electrostatic attraction when the said receiving sheet is removed from the said platen.

5. An impact printer for pressure fixable powder characterised by the provision of magnetic field producing means which hold the said pressure fixable powder in position on or adjacent to a receiving member and type face impact means movable to press the said powder on to the said receiving member, while so magnetically held whereby to pressure fix the said powder where pressed to the said receiving member.

6. An impact printer for pressure fixable powder characterised by the provision of electrostatic field producing means which holds the said pressure fixable powder in position, on or adjacent to a receiving member, and type face impact means movable to press the said powder on to the said receiving member while so electrostatically held whereby to pressure fix the said powder where pressed to the said receiving member.

7. An impact printer for pressure fixable powder characterised by the provision of electrostatic field producing means which hold the said pressure fixable powder to said type face impact means.

* * * * *